US008925611B2

(12) United States Patent
Hagglund et al.

(10) Patent No.: US 8,925,611 B2
(45) Date of Patent: Jan. 6, 2015

(54) ADHESIVE TAPE DISPENSER FOR SINGLE HAND OPERATION

(75) Inventors: Joel K. Hagglund, Lonsdale, MN (US); Gerald E. Mueller, Eagan, MN (US); Joy A. Packard, Somerset, WI (US); Arthur V. Lang, Maplewood, MN (US); Jia Hu, Mounds View, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 123 days.

(21) Appl. No.: 13/642,640

(22) PCT Filed: Apr. 15, 2011

(86) PCT No.: PCT/US2011/032640
§ 371 (c)(1),
(2), (4) Date: Oct. 22, 2012

(87) PCT Pub. No.: WO2011/133413

PCT Pub. Date: Oct. 27, 2011

(65) Prior Publication Data

US 2013/0037206 A1 Feb. 14, 2013

Related U.S. Application Data

(60) Provisional application No. 61/327,125, filed on Apr. 23, 2010.

(51) Int. Cl.
*B32B 38/04* (2006.01)
*B65H 35/00* (2006.01)

(52) U.S. Cl.
CPC ..... *B65H 35/0086* (2013.01); *B65H 35/0033* (2013.01)
USPC ..... 156/523; 156/527; 156/574; 156/579

(58) Field of Classification Search
CPC B32B 37/0046; B32B 38/04; B32B 38/0004; B65H 35/0086; B65H 35/0033
USPC ..... 156/523, 527, 574, 579; 206/411; 225/39, 44, 45, 56, 67, 72, 91
See application file for complete search history.

(56) References Cited

U.S. PATENT DOCUMENTS 2,606,682 A * 8/1952 Cutter ..... 156/523
3,619,324 A * 11/1971 Sato et al. ..... 156/384

(Continued)

FOREIGN PATENT DOCUMENTS

JP 61041160 3/1986
JP 2004-307218 11/2004

(Continued)

OTHER PUBLICATIONS

International Search Report for PCT International Application No. PCT/US2011/032640, mailed on Jul. 22, 2011, 4 pages.

*Primary Examiner* — Linda L Gray
(74) *Attorney, Agent, or Firm* — Kevin W. Weber; Robert H. Jordan

(57) ABSTRACT

An adhesive tape dispenser is provided that includes a lower housing (200) that includes a pivot post (212) substantially perpendicular to a back wall of the lower housing, a back plate (230) assembly that includes a push button (244) assembly, a tape unwind spool (234), a lower pin (236), an upper pin (238), and a wedge (240) that is slideably engaged with the lower housing, and a blade assembly unit (260) that includes a cutter arm (262). The cutter arm includes a cutting blade (264) and a semi-tubular opening (270) that slideably engages the pivot post (212) of the lower housing. The cutter arm also includes an outer edge that guides along the wedge and lifts the forward end of the cutter arm (that includes the cutting blade) when the back plate assembly is urged forward by pressing the push button assembly forward. When the push button assembly is urged rearward, a lever arm and a lever foot (268) engage the upper and lower pin (238, 236) of the back plate assembly forcing the cutter arm to pivot so that the front of the cutter arm is forced downward allowing the cutting blade to cut the adhesive tape.

8 Claims, 5 Drawing Sheets

(56) References Cited

U.S. PATENT DOCUMENTS

| | | | | |
|---|---|---|---|---|
| 4,097,328 | A | 6/1978 | Urushizaki | |
| 4,345,966 | A * | 8/1982 | Iiyama et al. | 156/523 |
| 4,792,375 | A * | 12/1988 | Lin | 156/510 |
| 4,804,437 | A * | 2/1989 | Tirtoprodjo et al. | 156/577 |
| D328,097 | S | 7/1992 | Czech | |
| D337,787 | S | 7/1993 | Oga | |
| 5,326,421 | A | 7/1994 | Taylor | |
| 5,518,576 | A | 5/1996 | Mendelovich | |
| 6,053,233 | A | 4/2000 | Lin | |
| D438,567 | S | 3/2001 | Van Den Berg | |
| D448,416 | S | 9/2001 | Kimura | |
| D449,858 | S | 10/2001 | Liu | |
| 6,386,415 | B1 | 5/2002 | Tsai | |
| D466,939 | S | 12/2002 | Lee | |
| 6,510,884 | B1 | 1/2003 | Chan | |
| 6,554,045 | B1 * | 4/2003 | Lee | 156/577 |
| D475,744 | S | 6/2003 | De Man | |
| D475,746 | S | 6/2003 | Ono | |
| D485,302 | S | 1/2004 | Bain | |
| 6,712,113 | B1 * | 3/2004 | Peggion | 156/577 |
| D492,355 | S | 6/2004 | Suzuki | |
| D494,623 | S | 8/2004 | Huang | |
| 6,896,025 | B2 | 5/2005 | Urushizaki | |
| D508,085 | S | 8/2005 | Herrmannsen | |
| D515,136 | S | 2/2006 | Herrmannsen | |
| D518,854 | S | 4/2006 | Paulus et al. | |
| D542,351 | S | 5/2007 | Rolion | |
| 7,255,767 | B2 | 8/2007 | Rice | |
| 7,320,351 | B2 | 1/2008 | Chern | |
| D570,919 | S | 6/2008 | Chan | |
| D573,646 | S | 7/2008 | Wolff | |
| D574,892 | S | 8/2008 | Kouda | |
| D588,645 | S | 3/2009 | Burton | |
| D600,751 | S | 9/2009 | Gallay | |
| 7,669,631 | B2 | 3/2010 | Bailey | |
| D634,784 | S | 3/2011 | Trotter | |
| 2003/0024651 | A1 | 2/2003 | Urushizaki | |
| 2009/0178767 | A1 | 7/2009 | Shen | |
| 2009/0179061 | A1 | 7/2009 | Dureiko | |
| 2012/0018087 | A1 | 1/2012 | Hu | |

FOREIGN PATENT DOCUMENTS

| | | |
|---|---|---|
| WO | WO 2008-068555 | 6/2008 |
| WO | WO 2011-133413 | 10/2011 |

* cited by examiner

ADHESIVE TAPE DISPENSER FOR SINGLE HAND OPERATION

CROSS-REFERENCE TO RELATED APPLICATION

This application claims priority to PCT Application No. US2001/032640, filed Apr. 15, 2011, and U.S. Provisional Application No. 61/327,125, filed Apr. 23, 2010.

FIELD

The present disclosure relates to adhesive tape dispensers and more particularly adhesive tape dispensers that can dispense adhesive tape with one hand operation.

BACKGROUND

Adhesive tape dispensers are well known devices. For example, U.S. Pat. No. 4,097,328 (Urushizaki) teaches an adhesive tape dispenser used to apply cellophane adhesive tape and automatically cut it. The tape dispenser includes a spring-loaded swing member, a tape press roller mounted on the bottom of the swing member, and a blade-carrying disc mounted to be rotatable as the swing member is pivoted up and down. U.S. Pat. No. 7,320,351 (Chern) teaches an adhesive tape dispenser that includes a housing comprising a rear spring, a forward opening, and a forward tape press roller; a tape dispensing unit urged by the spring and comprising a tape mount with an adhesive tape roll rotatably put thereon, a push member projected from the opening; and a cutter unit pivotably mounted in the housing comprising a front cutting blade and a top ridge. Placing the cutter on a surface to be sealed with the tape slightly projected from the opening and adhered on the surface and sliding the cutter will press the tape against the surface by the tape press roller for adhering thereto. After dispensing a desired length of the tape, pushing the push member will cause it to press down and pass over the ridge and press the blade to cut the tape off its roll with the spring being compressed. This adhesive tape dispenser is capable of being operated with one hand.

FIG. 1 is a perspective view of a tape cutter (adhesive tape dispenser) disclosed in U. S. Pat. No. 7,320,351 (Chern) with the side plate removed. The cutter 100 comprises a housing 101 consisting of two mated side plates. Within the housing 101 there is provided at least one tab at one side plate, each tab adapted to snugly insert into a hole (not shown) at the other side plate for fastening both side plates together, bar 113 projected forwardly from a rear end, a first shaft 111 at a forward opening with tape press roller 115 rotatably mounted thereon, and second shaft 112 projected laterally from one side plate.

The cutter further comprises tape dispensing unit 102 including tubular tape mount 121 with an adhesive tape roll to be rotatably put thereon, push member 122 projected from the opening, a tape guide below push member 122 for pressing onto a tape (not shown), and platform 123 a proximate tape guide. The platform 123 and a tape guide are adapted to facilitate the pulling of tape out of the cutter.

The cutter further comprises coil spring 104 put on bar 113 and biased between an inner wall of the cutter and a rear recess of tape dispensing unit 102 such that tape dispensing unit 102 is able to move closer to the inner wall of the cutter by compressing spring 104 in a tape cutting operation after dispensing a tape as detailed later. The cutter further comprises cutter unit 103 having a rear tubular portion rotatably mounted on second shaft 112 and including front cutting blade 131, mounting plate 132 for fixedly fastening blade 131 onto a front end of a block member, and top ridge 134 disposed proximate push member 122.

Referring to FIG. 1, in operation, the cutter is placed on a surface to be sealed with an open end of adhesive tape roll 105 slightly projected from the opening and adhered on the surface. Next, the cutter is made to slide on the surface with tape 105 pressed against the surface by tape press roller 115 for adhering tape 105 to the surface. When a desired length of tape 105 has been put thereon, a user may push member 122 rearward to press down and pass over ridge 134 until ridge 134 is stopped by an edge of the opening. Also, blade 131 is pressed to cut tape 105 off its roll with spring 104 being compressed.

Occasionally, during operation of one-handed adhesive tape dispensers, such as the one discussed above, tape can jam inside of the dispenser causing an inconvenience to the end user. The end user then has to take apart the two halves, rethread the dispenser, and start again. The problem can occur when the end user does not complete the full stroke of the applicator button. When this happens, the blade may still come in contact with the tape and the tape tears. As result, the tape can accumulate behind the blade. When the applicator button is released, the tape can spring forward and hit the blade before it is retracted causing the tape to jam inside of the dispenser. Thus, there is a need for adhesive tape applicators that can be operated with one hand, are simple to operate and manufacture, and which resist jamming due to tape accumulation behind the blade.

Summary

The provided adhesive tape dispenser has the advantages of being safe to the user in operation, being operable by a single hand, and being applicable to a variety of adhesive tapes. Additionally, the provided adhesive tape dispenser overcomes the problem of jamming due to tape accumulation behind the blade by providing a pivotable lever arm on the blade holder assembly that can be urged suddenly downward by contact with a wedge, an upper pin, and a lower pin attached to a back plate when a push button assembly attached to the back plate is urged rearward by a user. The provided adhesive tape dispenser delays contact of the blade with the adhesive tape when the pushbutton assembly is urged rearward compared to the prior art and then quickly cuts the tape. The delayed, quick downward motion of the cutting blade allows for fast cutting action of the blade on the adhesive tape while minimizing the contact time of the blade or parts of the blade assembly with the tape. The minimized contact time can significantly reduce or even eliminate tape jamming inside of the dispenser.

In one aspect, an adhesive tape dispenser is provided that includes a lower housing having a perimeter, the lower housing comprising an inner edge, an inner wall, at least two alignment features, a forward tape press roller, a pivot post, a forward slide stop, a rear slide stop, a forward lateral ridge, and a rear lateral ridge, wherein the inner edge substantially surrounds the perimeter of the lower housing except for two noncoplanar sections that define a button opening and a forward opening respectively, and wherein the forward tape press roller, the pivot post, and the forward lateral ridge project inwardly from the inner wall of the lower housing; a back plate assembly that includes a back plate having an oblong opening and having a front side and a back side, the front side comprising a tape unwind spool, a lower pin, an upper pin, and a wedge projecting from the front side of the back plate, a push button assembly attached to and projecting from the front side of the back plate, a forward and a rear guiding bracket that each slidably engage the forward lateral ridge and the rear lateral ridge of the lower housing, respectively, a tape spool bridge unit that is semi-tubular and comprises a rear slide stop opening that slidably engages the rear slide stop on the lower housing; and a coil spring located within the inner part of the tape spool bridge unit and contacts the forward end of the tape spool bridge unit and the rear slide stop, wherein the pivot post projects through the oblong opening in the back plate; and a blade assembly unit comprising a cutting arm having a forward end and a backward end attached to a cutting blade at its forward end, a lever arm having an outer edge and a lever foot, the lever arm being attached to the blade holder at its backward end and comprising a lever foot projecting from the lever arm, and a semi-tubular opening at a juncture of the backward end of the blade holder rotatably engaging the pivot post of the lower housing, wherein the outer edge of the lever arm slideably engages the wedge of the lower housing, wherein the lever foot slideably engages the back plate, and wherein the lever foot located between the lower pin and the upper pin of the back plate.

In another aspect a method of cutting an adhesive tape using a provided adhesive tape dispenser wherein the cutting blade cuts though the adhesive tape only after the push button assembly has been urged rearward greater than about 80% of the total distance the push button assembly can be urged.

In this disclosure:

"forward" or "front" refers to the direction towards the dispensing end of the tape dispenser;

"rearward" or "rear" refers to the direction away from the dispensing end of the dispenser;

"inner" refers to the direction or side facing towards the inside of the tape dispenser or upward (towards the observer) in FIGS. 2, 3*a*, 3*b*, and 4;

"outer" refers to the direction or side facing away from the inside of the tape dispenser; and "semi-tubular opening" refers to an opening bounded by a cylinder that is flat on one side or that defines a semicircular cross section.

The above summary is not intended to describe each disclosed embodiment of every implementation of the present invention. The brief description of the drawings and the detailed description which follows more particularly exemplify illustrative embodiments.

DETAILED DESCRIPTION

Figure 1:
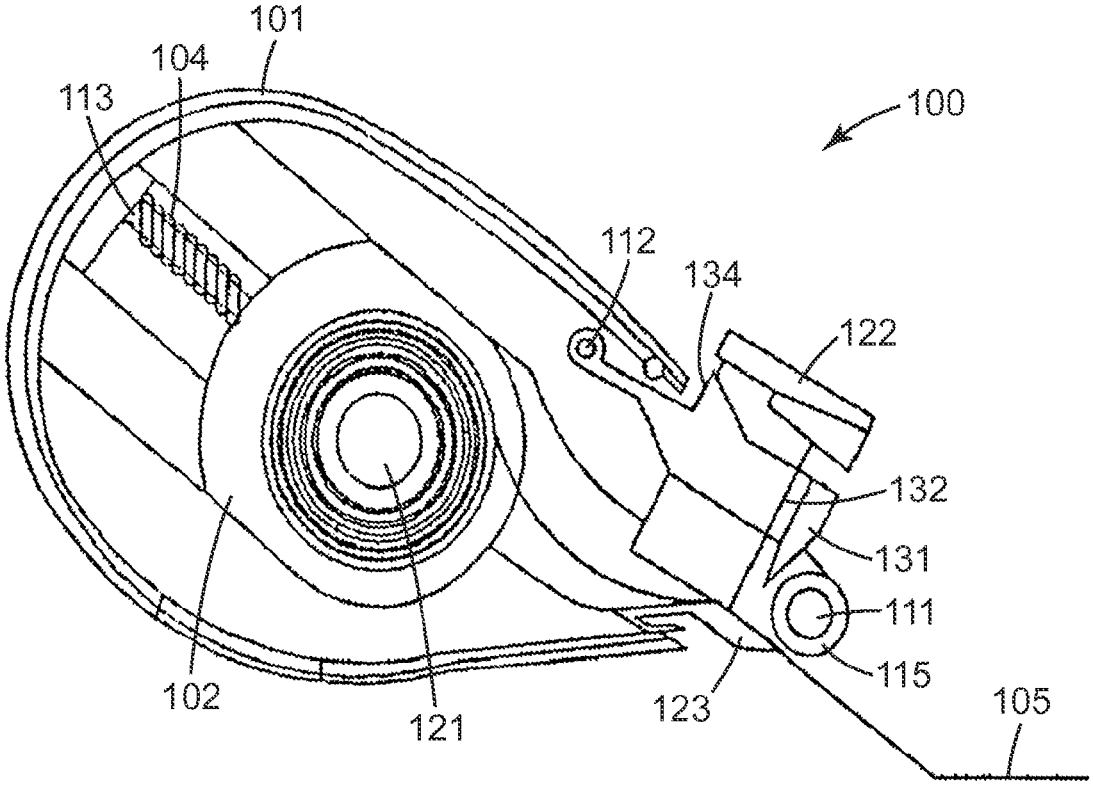
Fig. 1 Prior Art
FIG. 1 is a side view of a tape cutter disclosed in U.S. Pat. No. 7,320,315 with the side plate removed.

In the following description, reference is made to the accompanying set of drawings that form a part of the description hereof and in which are shown by way of illustration several specific embodiments. It is to be understood that other embodiments are contemplated and may be made without departing from the scope or spirit of the present invention. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. The use of numerical ranges by endpoints includes all numbers within that range (e.g. 1 to 5 includes 1, 1.5, 2, 2.75, 3, 3.80, 4, and 5) and any range within that range.

Referring to FIGS. 2, 3*a*, 3*b*, and 4, an embodiment of a provided adhesive tape dispenser is illustrated. The dispenser comprises lower housing 200 designed to fit together with an upper housing (not shown). At least two alignment features (not shown) in the upper housing fit into at least two alignment features in the lower housing. In the embodiment shown in FIGS. 2, 3*a*, 3*b*, and 4 the alignment features in lower housing 200 include at least two alignment holes 222 and corresponding alignment features in the upper housing (not shown) include at least two location pins. When the lower housing is mated with the upper housing, the upper housing and lower housing 200 substantially contact each other along inner edge 202 of lower housing 200 and a corresponding inner edge on the upper housing. Other alignment features such as, for example, ridges and grooves, interfacing surface features, tabs, recesses, and the like are also contemplated.

The provided adhesive tape dispenser includes lower housing 200, back plate assembly 230, and blade holder assembly 260. As discussed above, the provided adhesive tape dispenser can also include an upper housing that comprises an inner edge and at least two alignment features, wherein the inner edge upper housing makes contact with the inner edge of the lower housing thereby substantially encasing the back plate assembly and the blade assembly unit.

Lower housing 200 includes inner wall 204 and has inner edge 202 that substantially surrounds the perimeter of lower housing 200. Inner edge 202 matches a similar inner wall on the upper housing to substantially enclose the adhesive tape dispenser working parts to be described herein when the lower housing is mated to the upper housing. Inner edge 202 includes forward opening 206 through which tape can be dispensed and push button opening 210 through which push button assembly 244 can protrude. Lower housing 200 includes pivot post 212 and forward tape press roller 208 projecting inward substantially perpendicular from inner wall 204. Forward tape press roller 208 is located within forward opening 206 and functions to press adhesive tape exiting the dispenser onto a substrate. Lower housing 200 also includes forward lateral ridge 214 and rear lateral ridge 216 projecting inward from inner wall 204. Forward lateral ridge 214 and rear lateral ridge 216 are substantially collinear. Forward lateral ridge 214 extends substantially from forward opening 206 to back plate assembly slide rail 224 upon which the outer portion of the back plate assembly is slideably engaged when the dispenser is assembled. Forward lateral ridge 214 includes forward slide stop 218 and back plate assembly slide rail 224 includes rear slide stop 220. Slide stops 218 and 220 define the forward and rear slide limits of back plate assembly 230 during operation of the dispenser.

Figure 2:
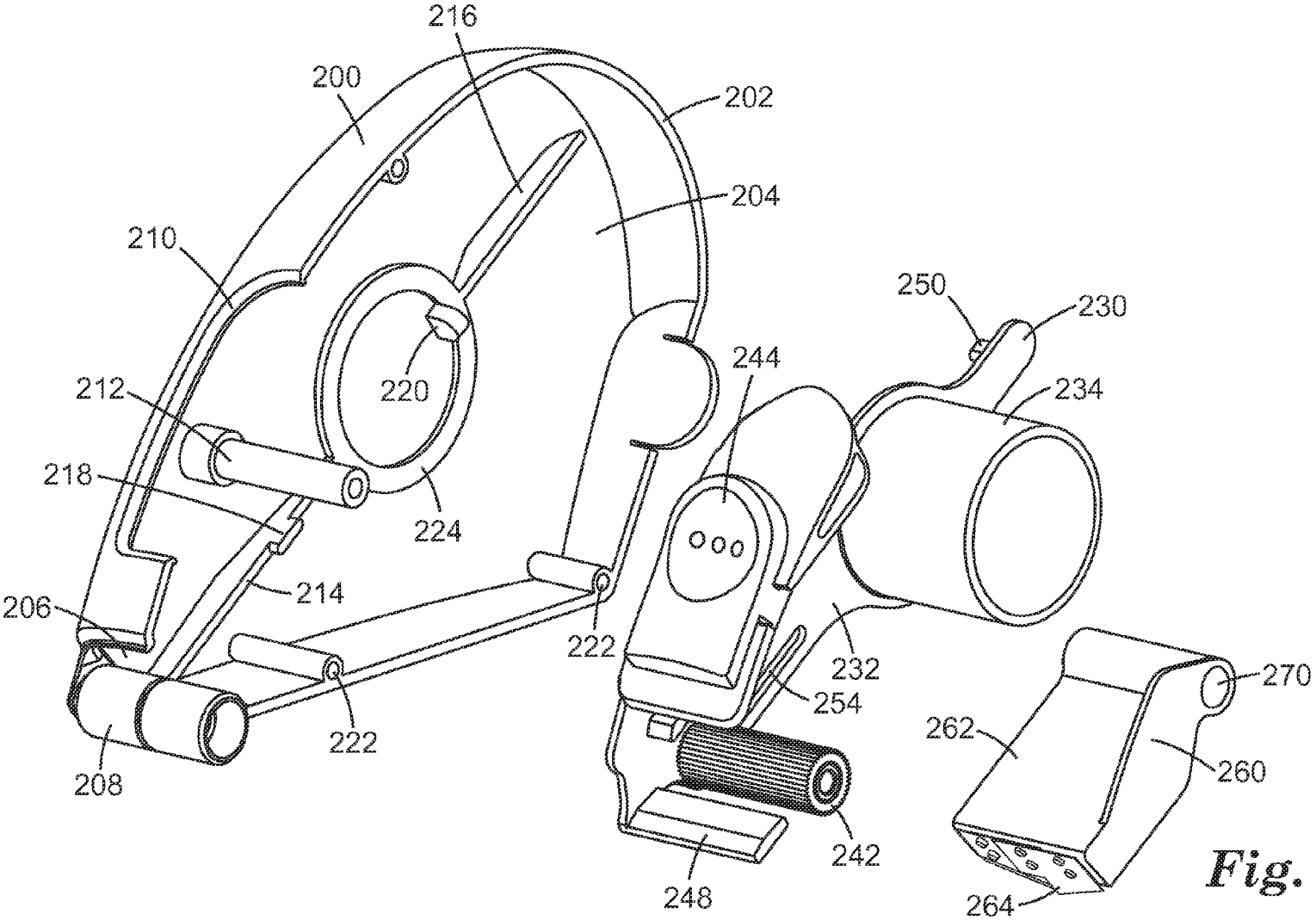
FIG. 2 is an exploded perspective view of an embodiment of a provided adhesive tape dispenser.
Figure 3A:
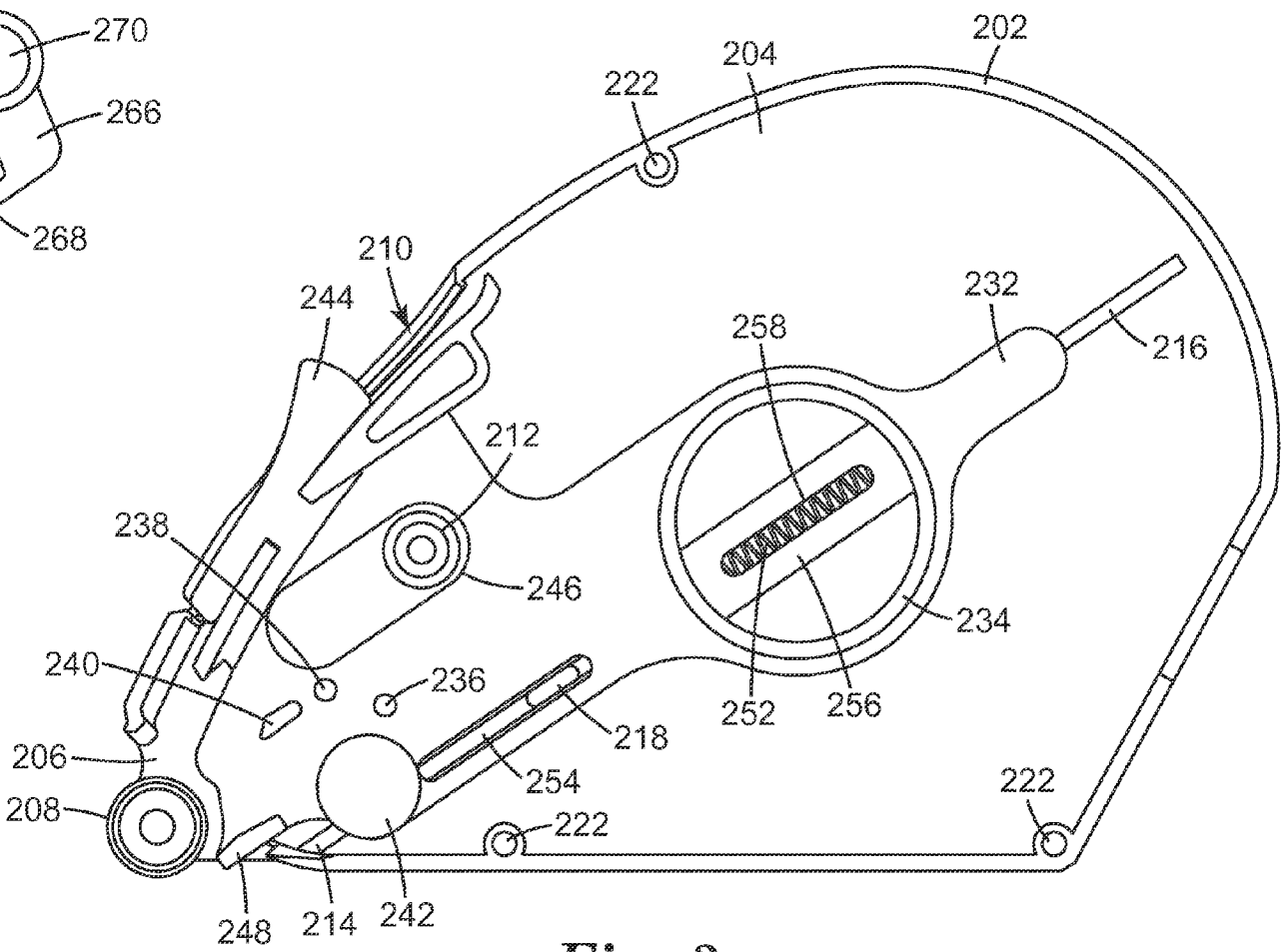
FIG. 3*a* is a side view of the adhesive tape dispenser shown in FIG. 2 with the back plate assembly in place and the cutting unit removed.
Figure 3B:
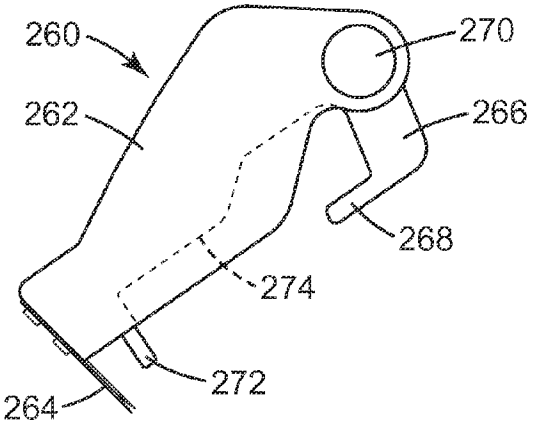
FIG. 3*b* is a side view of the cutting unit of an embodiment of a provided adhesive tape dispenser.
Figure 4:
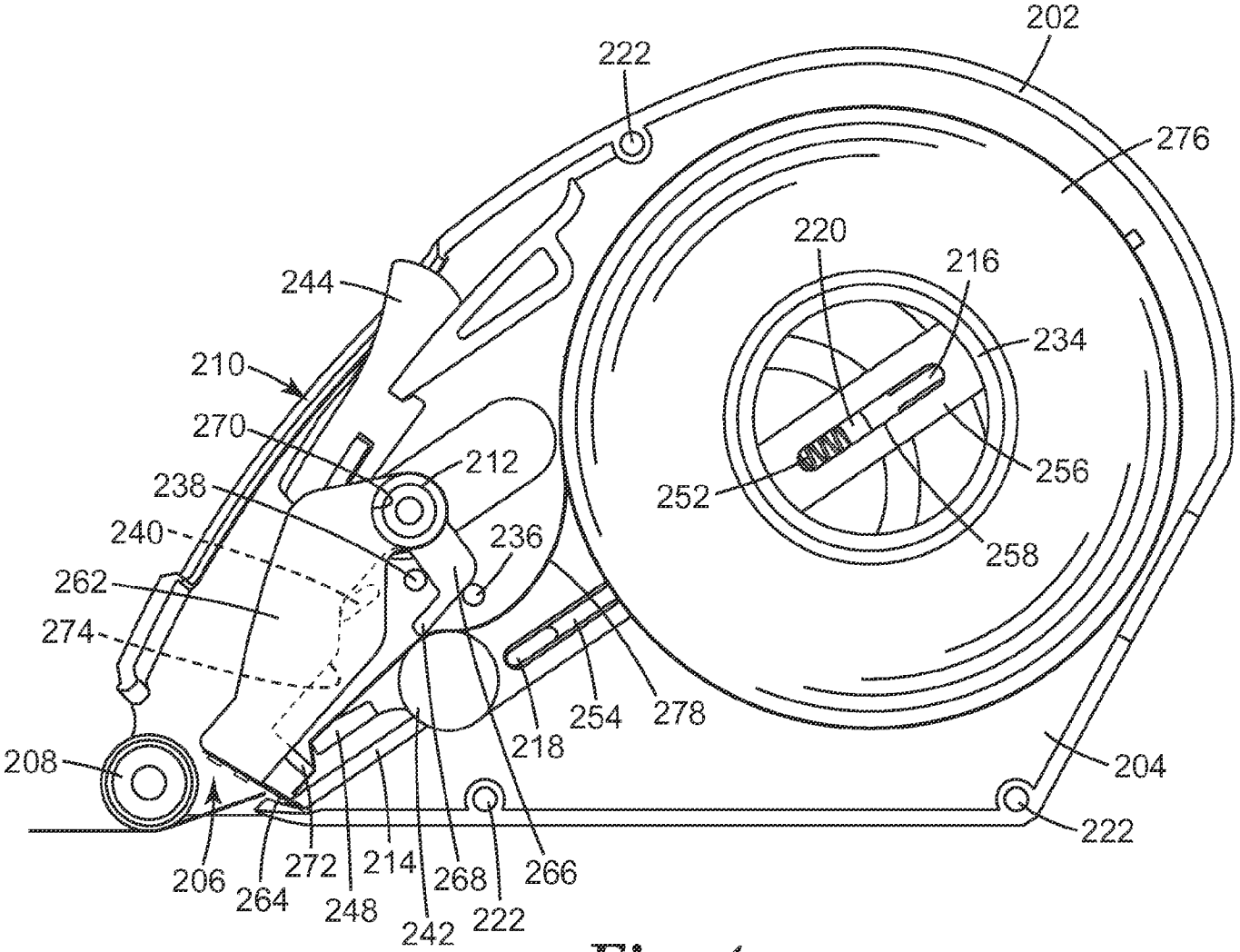
FIG. 4 is a side view of an embodiment of a provided assembled adhesive tape dispenser.

The provided adhesive tape dispenser includes back plate assembly 230 shown by itself in FIG. 2, shown installed in lower housing 200 in FIG. 3, and shown FIG. 4 as a part of the complete adhesive tape dispenser assembly. Back plate assembly 230 has an inward side (shown in FIGS. 2, 3*a*, and 4) and an outward side (not visible in drawings) that faces opposite inner wall 204 of lower housing 200. Back plate assembly 230 includes back plate 232 that has tape guide 248 projecting inward substantially perpendicular from back plate 232 at its forward end. The forward end of back plate assembly 230 includes idler roller 242 also projecting inward substantially perpendicular to back plate 232. Wedge 240, upper pin 238, and lower pin 236 all project inward from back plate 232 above idler roller 242. Their function is to guide movement of blade holder assembly 260 and will be described further on. Back plate 232 is attached to push button assembly 244 attached to and projecting from the front side of back plate 232 that projects through button opening 210 when the back plate assembly is engaged into the lower housing as shown in FIG. 3*a*. Back plate 232 also has oblong opening 246 which slideably engages pivot post 212 of lower housing 200 when assembled as also shown in FIG. 3*a*.

Back plate 232 also includes forward slide stop opening 254 that slideably engages forward slide stop 218 of lower housing 200. The outward side (not shown) of back plate assembly includes two sets of guiding brackets (a forward guiding bracket not shown) and a rear guiding bracket 250) that slideably engage, respectively, forward lateral ridge 214 and rear lateral ridge 216 of lower housing 200 when assembled. Each bracket comprises two small tabs that extend a short distance substantially perpendicular to back plate assembly 230 towards inner wall 204 of lower housing 200. When the back plate assembly is positioned in the lower housing, forward lateral ridge 214 slides between the two tabs of the forward bracket and rear lateral ridge 216 slides between the two tabs of the rear bracket 250. The forward bracket is located near the forward end of the back plate assembly and the rear bracket 250 is located at the rear end of the back plate assembly, beyond the tape unwind spool.

Back plate assembly 230 also includes tape spool bridge unit 256 that is substantially coplanar with back plate 232 and spans the diameter of tape unwind spool 234. Tape spool bridge unit 256 is semi-tubular with a flat outward side coplanar and connected with the outward side of back plate 232. The inner part of tape spool bridge unit 256 is semi-tubular and includes rear slide stop opening 258 that slideably engages rear slide stop 220 of lower housing 200 when assembled as shown in FIGS. 3*a* and 4. Tape spool bridge unit 256 also includes coil spring 252 located within the inner part of tape spool bridge unit 256 and that can be compressed by contact with the forward end of tape spool bridge unit 256 and rear slide stop 220 as shown in FIG. 4.

The provided adhesive tape dispenser further includes blade holder assembly 260. Blade holder assembly 260 includes cutting blade 264 projecting downward from the forward end of blade holder assembly 260 as shown in FIGS. 2 and 4. FIG. 3*b* is a side view of blade holder assembly 260 and displays blade holder assembly 260. FIG. 3*b* illustrates another view of cutting blade 264 projecting downward from the forward end of blade holder assembly 260. Blade holder assembly 260 also includes tape hold down post 272 projecting substantially perpendicular to blade holder assembly 260 also in a downward direction. The rear portion of blade holder assembly 260 includes semi-tubular opening 270 that can rotatable engage pivot post 212 of lower housing 200. Lever arm 266 extends substantially perpendicular from the outside portion (flush with the outside surface (facing opposite the inner portion of back plate 232) of the rear of blade holder assembly 260. Lever arm 266 comprises lever foot 268 which is substantially perpendicular to lever arm 266 and substantially parallel to blade holder assembly 260. FIG. 4 shows blade holder assembly 260 in place in the assembled adhesive tape dispenser. Blade holder assembly 260 engages pivot post 212 in semi-tubular opening 270. When in place, blade holder assembly 260 is engaged so that lever arm 266 is flush against the inner surface of back plate 232. The profile of the outward side of blade holder assembly 260 that is flush with back plate 232 is shown in dotted lines in FIG. 4. There is a wider inner rim on blade cutter assembly to laterally guide push button assembly 244 of back plate assembly 230 when push button assembly 244 is urged forward (when dispensing tape) or rearward (when cutting tape). When in place, lever foot 268 fits between upper pin 238 and lower pin 236 and outer edge 274 of blade holder assembly 260 guides along wedge 240. Its operation is described further on.

The operation of the provided adhesive tape dispenser can be understood by referencing FIGS. 3*a* and 4. FIG. 4 illustrates the threading of adhesive tape 278 through the provided adhesive tape dispenser. In this illustration, back plate assembly 230 is in its rear position and blade holder assembly 260 is in its downward cutting position. Adhesive tape 278 is unwound from tape spool 276 such that it passes between idler roller 242 and blade holder assembly 260. Idler roller 242 has a low energy surface that does not stick to adhesive tape 278 since the adhesive side of the tape traverses over the top of idler roller 242. Adhesive tape 278 then passes over tape guide 248, under tape hold down post 272, and under cutting blade 264. When the adhesive tape dispenser is in "cutting position" such as that illustrated in FIG. 4, the tape has been cut. The remainder of the tape passes out of forward opening 206, under forward press roller 208 as it is pressed onto the substrate (not shown). In this "cutting position", the back plate assembly is in its furthest backward position (where forward slide stop 218 contacts the forward limit of forward slide stop opening 254) and coil spring 252 is compressed.

FIG. 3*a* illustrates the provided adhesive tape dispenser (with blade holder assembly 260 removed for easy viewing of back plate assembly 230) in its forward position. In this position, the back plate assembly 230 has been slid as forward as possible until forward slide stop 218 contacts the rearmost end of forward slide stop opening 254 and at the same time, rear slide stop 220 contacts the end of rear slide stop opening 258 (inside the semi-tubular underside of tape spool bridge unit 256). In this position coil spring 252 is in a relaxed state. The provided adhesive tape dispenser typically also includes an upper housing to enclose all of the working parts as described above.

The operation of the adhesive tape dispenser is herein described. When the provided adhesive tape dispenser is in its forward position (as described above), cutter arm 262 is in its upward position due to the forward portion of outer edge 274 of blade holder assembly 260 slideably engaging wedge 240 which forces cutter arm 262 up and cutting blade 264 out of the path of the adhesive tape. In this position push button assembly 244 is also in its forward position allowing the user to press down on the push button assembly, apply pressure to forward tape press roller 208 which in turn presses down on adhesive tape 278 (not shown in FIG. 3*a*). The user can move the whole tape dispenser rearward allowing adhesive tape to be dispensed from the dispenser until the user desires to cut the tape.

Figure 5:
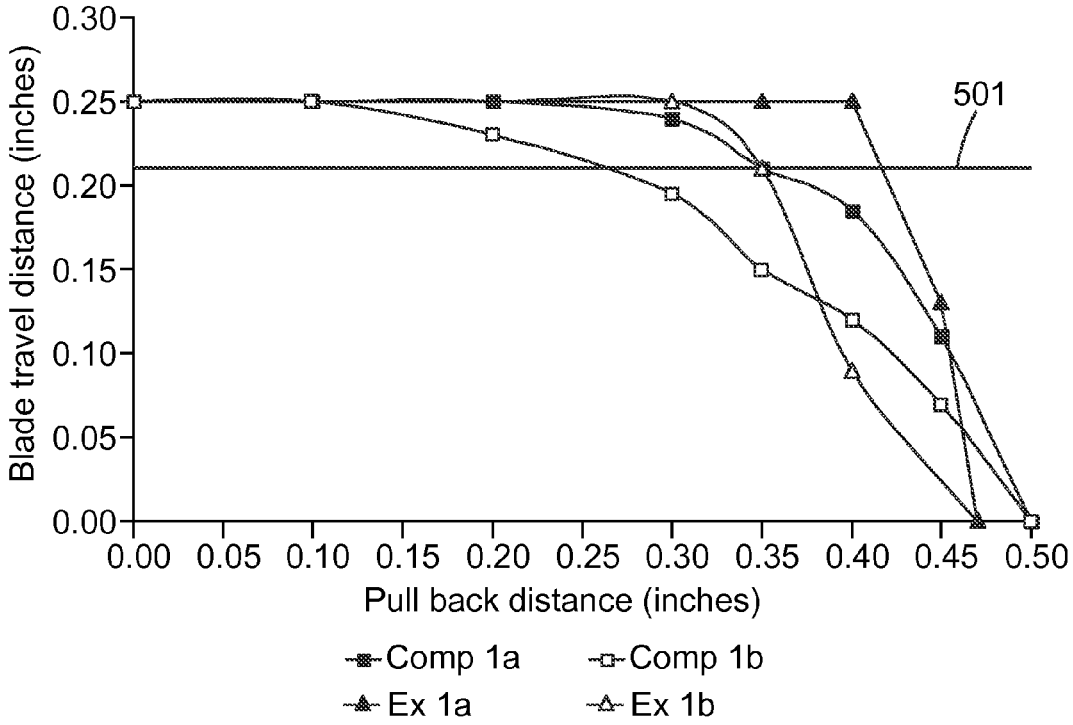
FIG. 5 is a graph of operational parameters of a provided adhesive tape dispenser compared to a prior art tape dispenser.

To cut the tape, the user urges push button assembly 244 from its forward position (shown in FIG. 3*a*) to its rear position (shown in FIG. 4). Since push button assembly 244 is attached to back plate 232 and blade holder assembly 260 is attached to pivot post 212 (part of lower housing 200), when push button assembly 244 is urged rearward, the outer edge of lever arm 266 of blade holder assembly 260 pushes against upper pin 238 and lower pin 236 to cause cutting unit 206 to pivot counterclockwise. This forces tape hold down post 272 to hold adhesive tape 278 and allows cutting blade 264 to cut though adhesive tape 278. To resume adhesive tape dispensing, the user urges push button assembly 244 forward causing cutting unit to move to it "up" or non-cutting position again and tape dispensing can resume. FIG. 5 is a graph of operational parameters of a provided adhesive tape dispenser compared to a prior art tape dispenser. The prior art tape dispenser was the same one shown in FIG. 1. An 18 mm wide roll of SCOTCH MAGIC TAPE (available from 3M, St. Paul, Minn.) was loaded into each dispenser. The vertical blade travel distance was measured and graphed as a function of the pull back distance of the push button. Comp 1*a* and 1*b* display the blade travel distance vs. pull back distance of the prior art tape dispenser with a roll of SCOTCH MAGIC TAPE. Ex 1*a* and 1*b* show the same data for the embodiment of the provided adhesive tape dispenser shown in FIG. 4. The solid data points are for the rearward movement of the push button measured as the cutting blade was moving downward and cutting through the tape. The hollow points are for the forward movement of the push button as the cutting blade was retracted to its rest position (0.00 pull back distance). Line 501 was the blade travel distance point wherein the blade first contacted the tape (in the downward direction) or the last point wherein the blade last contacted the tape (in the upward direction). The data displayed in FIG. 5 show that the cutting blade in the provided adhesive dispenser contacts the adhesive tape for a much shorter time on cutting and retracting than the prior art dispenser. The cutting blade contacts the adhesive tape after the push button assembly has been urged rearward about 0.42/0.47 or 89% of the total distance the push button assembly can be urged. In other embodiments, the cutting blade can contact the adhesive tape after the push button assembly has been urged rearward about 80% of the total distance, about 85% of the total distance, or even about 89% of the total distance the push button assembly can be urged.

The provided adhesive tape dispenser is compact and designed so that it can be operated by one hand of a user. Since the cutting blade resides retracted within the lower housing (and upper housing) at all times except when cutting the tape, there is no need to worry about the hand of the user coming into contact with the blade. The provided adhesive tape dispenser has the advantage, due to the placement of the upper pin, the lower pin, and the wedge and the blade holder assembly to allow for a very fast downward cutting motion upon operation of the dispenser for cutting tape. The combination of the relatively short cutter arm and the function of the lever arm and lever foot guided by the wedge, the upper pin, and the lower pin, allow for very quick cutting and retracting of the cutting blade. These features overcome jamming due to tape accumulation behind the blade.

Various modifications and alterations to this invention will become apparent to those skilled in the art without departing from the scope and spirit of this invention. It should be understood that this invention is not intended to be unduly limited by the illustrative embodiments and examples set forth herein and that such examples and embodiments are presented by way of example only with the scope of the invention intended to be limited only by the claims set forth herein as follows. All references cited in this disclosure are herein incorporated by reference in their entirety.

What is claimed is:

1. An adhesive tape dispenser comprising:

a lower housing having a perimeter, the lower housing comprising an inner edge, an inner wall, at least two alignment features, a forward tape press roller, a pivot post, a forward slide stop, a rear slide stop, a forward lateral ridge, and a rear lateral ridge, wherein the inner edge substantially surrounds the perimeter of the lower housing except for two noncoplanar sections that define a button opening and a forward opening respectively, and wherein the forward tape press roller, the pivot post, and the forward lateral ridge project inwardly from the inner wall of the lower housing;

a back plate assembly that includes a back plate having an oblong opening and having a front side and a back side, the front side comprising:

a tape unwind spool;

a lower pin, an upper pin, and a wedge projecting from the front side of the back plate;

a push button assembly attached to and projecting from the front side of the back plate;

a forward and a rear guiding bracket that each slidably engage the forward lateral ridge and the rear lateral ridge of the lower housing, respectively;

a tape spool bridge unit that has an inner part and a forward end, is semi-tubular, and comprises a rear slide stop opening that slidably engages the rear slide stop on the lower housing; and a coil spring located within the inner part of the tape spool bridge unit and contacts the forward end of the tape spool bridge unit and the rear slide stop, wherein the pivot post projects through the oblong opening in the back plate; and a blade assembly unit comprising:

a cutting arm having a forward end and a backward end attached to a cutting blade at the forward end of the blade assembly unit;

a lever arm having an outer edge and a lever foot projecting from the lever arm, the lever arm being attached to backward end of the blade assembly; and a semi-tubular opening at a juncture of the backward end of the blade assembly rotatably engaging the pivot post of the lower housing, wherein the outer edge of the lever arm slideably engages the wedge of the back plate assembly, wherein the lever foot slideably engages the back plate, and wherein the lever foot is located between the lower pin and the upper pin of the back plate.

2. An adhesive tape dispenser according to claim 1, further comprising an upper housing that comprises an inner edge and at least two alignment features, wherein the inner edge upper housing makes contact with the inner edge of the lower housing thereby substantially encasing the back plate assembly and the blade assembly unit.

3. An adhesive tape dispenser according to claim 1, wherein the forward lateral ridge and the rear lateral ridge of the lower housing are substantially collinear.

4. An adhesive tape dispenser according to claim 3, wherein the forward lateral ridge comprises the forward slide stop.

5. An adhesive tape dispenser according to claim 3, wherein the rear lateral ridge comprises the rear slide stop.

6. An adhesive tape dispenser according to claim 1, wherein the back plate assembly further comprises an idler roller projecting from the forward end of the back plate assembly.

7. An adhesive tape dispenser according to claim 1, further comprising a tape guide attached to and projecting from the forward end of the back plate assembly.

8. A method of cutting an adhesive tape using an adhesive tape dispenser according to claim 1, wherein the adhesive tape dispenser comprises a roll of adhesive tape mounted on the tape unwind spool and the cutting blade cuts though the adhesive tape only after the push button assembly has been urged rearward greater than about 80% of the total distance the push button assembly can be urged.

* * * * *

UNITED STATES PATENT AND TRADEMARK OFFICE

CERTIFICATE OF CORRECTION

PATENT NO. : 8,925,611 B2
APPLICATION NO. : 13/642640
DATED : January 6, 2015
INVENTOR(S) : Joel Hagglund It is certified that error appears in the above-identified patent and that said Letters Patent is hereby corrected as shown below:

Specification

Column 1,
Line 8, delete "US2001/032640," and insert -- US2011/032640, --, therefor.

Column 5,
Line 27, delete "a rear" and insert -- (a rear --, therefor.

Signed and Sealed this
Twelfth Day of January, 2016

Michelle K. Lee

Michelle K. Lee
*Director of the United States Patent and Trademark Office*